US007478725B2

(12) United States Patent
Holley, Jr.

(10) Patent No.: US 7,478,725 B2
(45) Date of Patent: Jan. 20, 2009

(54) CARTON WITH DISPENSER

(75) Inventor: John M. Holley, Jr., Lawrenceville, GA (US)

(73) Assignee: Meadwestvaco Packaging Systems, LLC, Glen Allen, VA (US)

( * ) Notice: Subject to any disclaimer, the term of this patent is extended or adjusted under 35 U.S.C. 154(b) by 348 days.

(21) Appl. No.: 11/247,796

(22) Filed: Oct. 11, 2005

(65) Prior Publication Data

US 2007/0080083 A1 Apr. 12, 2007

Related U.S. Application Data

(60) Provisional application No. 60/617,803, filed on Oct. 11, 2004.

(51) Int. Cl.
*B65D 5/00* (2006.01)

(52) U.S. Cl. ..... 206/427; 229/242

(58) Field of Classification Search ..... 206/427, 206/429; 229/103.2, 210, 240, 242
See application file for complete search history.

(56) References Cited

U.S. PATENT DOCUMENTS

| | | | | |
|---|---|---|---|---|
| 3,178,242 | A | 4/1965 | Ellis | |
| 3,228,582 | A | 1/1966 | Osberg | |
| 4,375,258 | A * | 3/1983 | Crayne et al. | 206/141 |
| 4,396,143 | A | 8/1983 | Killy | |
| 5,881,884 | A | 3/1999 | Podosek | |
| 6,283,293 | B1 | 9/2001 | Lingamfelter | |
| 6,386,369 | B2 | 5/2002 | Yuhas et al. | |
| 6,578,736 | B2 | 6/2003 | Spivey | |
| 6,902,104 | B2 * | 6/2005 | Holley et al. | 229/242 |
| 2004/0188277 | A1 * | 9/2004 | Auclair | 206/139 |
| 2004/0188509 | A1 | 9/2004 | Holley, Jr. | |
| 2005/0126947 | A1 * | 6/2005 | Holley, Jr. | 206/427 |

FOREIGN PATENT DOCUMENTS

| | | |
|---|---|---|
| DE | 85 14 718.4 | 8/1985 |
| WO | WO 02/47990 | 6/2002 |

* cited by examiner

*Primary Examiner*—Jacob K Ackun, Jr.
(74) *Attorney, Agent, or Firm*—ParksKnowlton LLC; Tsugihiko Suzuki

(57) ABSTRACT

A carton for enclosing cylindrical articles includes a dispenser that provides access to at least two endmost articles in an uppermost row, and to at least one article in a lowermost row, when fully loaded. The dispenser is defined by contiguous severance lines that extend across the top wall, side walls, and end wall. The dispenser is opened by tearing the severance lines to define a stopper wall and as a recess in each side wall that, at its lowest point, is spaced at a distance above the bottom wall less than half the height of the carton, with the dimensions and position of the recess being sufficient to expose at least part of the ends of one or more lowermost articles. Each side wall severance line meets the end wall severance line at a distance above the bottom wall no less than half the height of the carton.

5 Claims, 3 Drawing Sheets

100

136b
138b
118
110
138a
136a
128b
130b
116
106
140
130a
128a
132b
134b
108
H
142
T
134a
132a
124b
126b
112
104
126a
124a
120b
122b
102
122a
120a

300

320b
322b
302
322a
320a
324b
326b
304
312
326a
324a
332b
334b
H2
314
308
T2
334a
332a
328b
330b
306
316
340
330a
328a
336b
338b
310
318
338a
336a

CARTON WITH DISPENSER

CROSS-REFERENCE TO RELATED APPLICATIONS

This application claims priority to U.S. Application No. 60/617,803, filed Oct. 11, 2004.

TECHNICAL FIELD

This invention relates generally to cartons for packaging multiple articles such as beverage cans or bottles, and more particularly, to a carton with an article dispenser for constrained removal of the articles, the dispenser being adapted to improve access to the articles contained therein.

BACKGROUND OF THE INVENTION

Cartons for encasing and dispensing multiple articles such as soft drink cans or bottles are useful for enabling consumers to transport, store, and access the articles for consumption. The consumer commonly removes only one article at a time, but typically prefers the flexibility to easily access two or more articles at a time. To that end, it is desirable to have cartons with dispensers which allow one or more articles to be removed at a time, while continuing to encase the remaining articles. The consumer tears out a portion of the carton to form an opening from which articles may be dispensed.

When the articles contained in the carton are cylindrical, and are disposed in the carton upon their sides, it is important that the articles be constrained such that the remaining articles do not roll out of the dispenser when one is removed. It is also important to restrain all of the articles such that when the carton is first opened, the first article does not unexpectedly and undesirably fall out of the carton. Thus, it can be appreciated that it would be desirable to have a carton with a dispenser that constrains articles to prevent the articles from undesirably rolling from or otherwise exiting the carton when one article is removed, or when the carton is first opened.

It is known to provide a carton having a dispenser for articles, which is provided when part of the carton is substantially detached or torn away from the upper end portion of the carton to expose an endmost article for removal. A problem associated with such known cartons is that a user can have difficulty in grasping articles to remove the articles from the dispenser. For example, there are typically multiple rows or tiers of horizontally disposed articles, one above the other, carried within the carton. Once the endmost article of an upper row of articles is removed from the carton through the dispenser, a user may find it difficult to secure a grip on the endmost article on the lower row of the carton. The present invention and its certain embodiments seek to overcome or at least mitigate the problems of the prior art.

It can be appreciated, therefore, that it also would be desirable to provide a carton having an improved article dispenser that is convenient to use and facilitates access to the articles.

SUMMARY OF THE INVENTION

The present invention advantageously reduces the effort required to access articles in a carton by providing a dispenser that defines a user-friendly means for grasping and removing the articles from the carton, and by providing a reliable article stopper. More specifically, according to the various embodiments of the invention, a carton is provided for enclosing at least two rows of horizontally disposed cylindrical articles, the carton having a dispenser that is sufficiently deep to allow a user to secure a handhold on the ends of at least one of the endmost articles on the lowermost row of the carton. The carton dispenser is also sufficiently large to expose more than one of the endmost articles on the uppermost row of the carton, such that a user can remove at least two articles at once. Furthermore, the carton dispenser defines a means for securely retaining the remaining articles in the carton.

Generally described, the invention provides a carton comprising a top wall, a pair of opposed side walls connected to opposing side edges of the top wall, an end wall interconnecting the side walls, a bottom wall interconnecting respective lower edges of the side walls and an article-dispenser including a removable portion disposed at an end of the carton. The removable portion is defined by severance lines formed respectively in the top wall, the side walls and an end wall. The severance line in each side wall comprises a recess in the respective side wall upon removal of the removable portion. In certain embodiments, the side wall recess is defined by a side wall severance line that is essentially U-shaped, thereby forming a concave section in each side wall. In other embodiments, the side wall recess is essentially V-shaped, being defined by a side wall severance line that extends from the top wall and partially down the side wall to a point, and curves back up toward the top wall. In the embodiments described, the side wall severance line begins at an edge of the top wall and terminates at an edge of the end wall.

According to one aspect of the invention, the depth of the side wall recess, as defined by the distance from the top wall of the carton to the lowermost point on the concave section, is sufficient to expose at least a portion of the ends of one or more articles on the lowermost row of articles.

According to another aspect of the invention, the side wall recess has sufficient width, as defined by the distance along the top wall edge between the end wall and the beginning of the side wall severance line, to expose at least a portion of the end edges of two or more articles.

According to another aspect of the invention, each side wall severance line extends downwardly from the top wall to the lowest point along its recessed section and further extends upwardly from the lowest point to the end wall to be continuous with an end wall severance line. Preferably, each side wall severance line extends to the connection of the respective side wall with the end wall at a distance above the bottom wall generally no less than half of the height of the carton. The lowest point of each side wall severance line may be spaced at a distance above the bottom wall less than a half of the height of the carton.

According to yet another aspect of the invention, the side wall severance lines, the end wall severance line and a top wall severance are segments of a single frangible line that defines at least one detachable portion that can be separately detached from the carton to define the opening for dispensing articles within the carton. The frangible line can include any known or yet to be developed severance means, such as a severance line weakened by perforations or cuts to facilitate tearing or breaking along the frangible line. As an alternative or supplement, a tear tape may be embedded or attached along the frangible line.

According to one aspect of certain embodiments, the end wall severance line extends continuously between the side walls so that an article stopper wall is formed from the end wall upon removal of the corner portion. Such a stopper wall extends continuously between the side walls. The highest point along the upper edge of the stopper wall is spaced at a first distance above the bottom wall while the lowest point along the recessed section of each side wall severance line is spaced at a second distance above the bottom wall. The first distance is no less than the second distance.

Another aspect of the invention provides a package comprising an article group formed of at least two vertically arranged tiers of similarly dimensioned, cylindrical articles disposed on their sides in a side-by-side parallel fashion, and a carton disposed around the article group. The carton comprises a plurality of walls including a top wall, a pair of opposed side walls connected to the opposed side edges of the top wall, an end wall interconnecting the side walls, a bottom wall interconnecting the respective lower edges of the side walls and an article dispenser for dispensing the articles from the carton. The dispenser includes a removable portion of the carton formed from the top, side and end walls. The removable portion is detachably connected to the top, side and end walls along a detachable connection to be removed from the carton thereby to define an opening for exposing at least some of the articles for removal. The opening is shaped to define a recess in each side wall to reveal at least a part of the endmost article in the lowermost tier of the article group.

The detachable connection comprises severance lines for defining the edge of the opening. The severance lines are formed respectively in the top wall, the side walls and the end wall, and the severance line in each side wall comprises a recessed section for defining the recess in the respective side wall.

Each side wall severance line extends downwardly from the top wall to the lowest point along its recessed section and further curves upwardly from the lowest point to the end wall to be continuous with the end wall severance line. In certain embodiments, the recessed section of each side wall severance line is essentially U-shaped. Alternatively, the recessed section of each side wall severance line comes to a point such that the recessed section is essentially V-shaped, optionally with one or both sides of the V being curved. Preferably, the side wall severance lines are disposed respectively across the opposite ends of the endmost articles in the lowermost tier.

In certain embodiments, each side wall severance line extends to the connection of the respective side wall with the end wall at a distance above the bottom wall greater or equal to approximately $((N \times D))-\frac{1}{2}D)$, where N is the number of vertically arranged tiers of articles in the article group, and D is the diameter of each article. For example, in a carton designed to contain two tiers of cans, each side wall severance line extends to the connection of the respective side wall with the end wall at a distance above the bottom wall generally equal to three halves of the diameter of each can.

In certain embodiments, the lowest point of each side wall severance line is preferably spaced at a distance above the bottom wall less than the diameter of each article.

In another class of embodiment, the end wall severance line extends continuously between the side walls so that the article stopper wall is formed from the end wall upon removal of the corner portion. The highest point along the upper edge of the stopper wall is spaced at a first distance above the bottom wall whereas the lowest point along the concave section of each side wall severance lines is spaced at a second distance above the bottom wall. The first distance is no less than the diameter of each article while the second distance may be less than the diameter of each article.

According to another aspect of the present invention, the carton is formed from a blank having a detachable connection comprising a preferably but not necessarily continuous frangible line at one end of the blank for defining the tear panel. The continuous frangible line preferably extends across at least a portion of a first side end flap hingedly connected to a first side wall, the frangible line originating on the distal edge and extending across the proximal edge of the first side end flap and onto the adjacent first side wall. The continuous frangible line continues transversely from the first side wall, across the top wall, and at least partially across the second side wall. The continuous frangible line turns and continues toward a second side end flap, terminating at the distal edge of the second end flap.

The foregoing has broadly outlined some of the aspects and features of the present invention, which should be construed to be merely illustrative of various potential applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
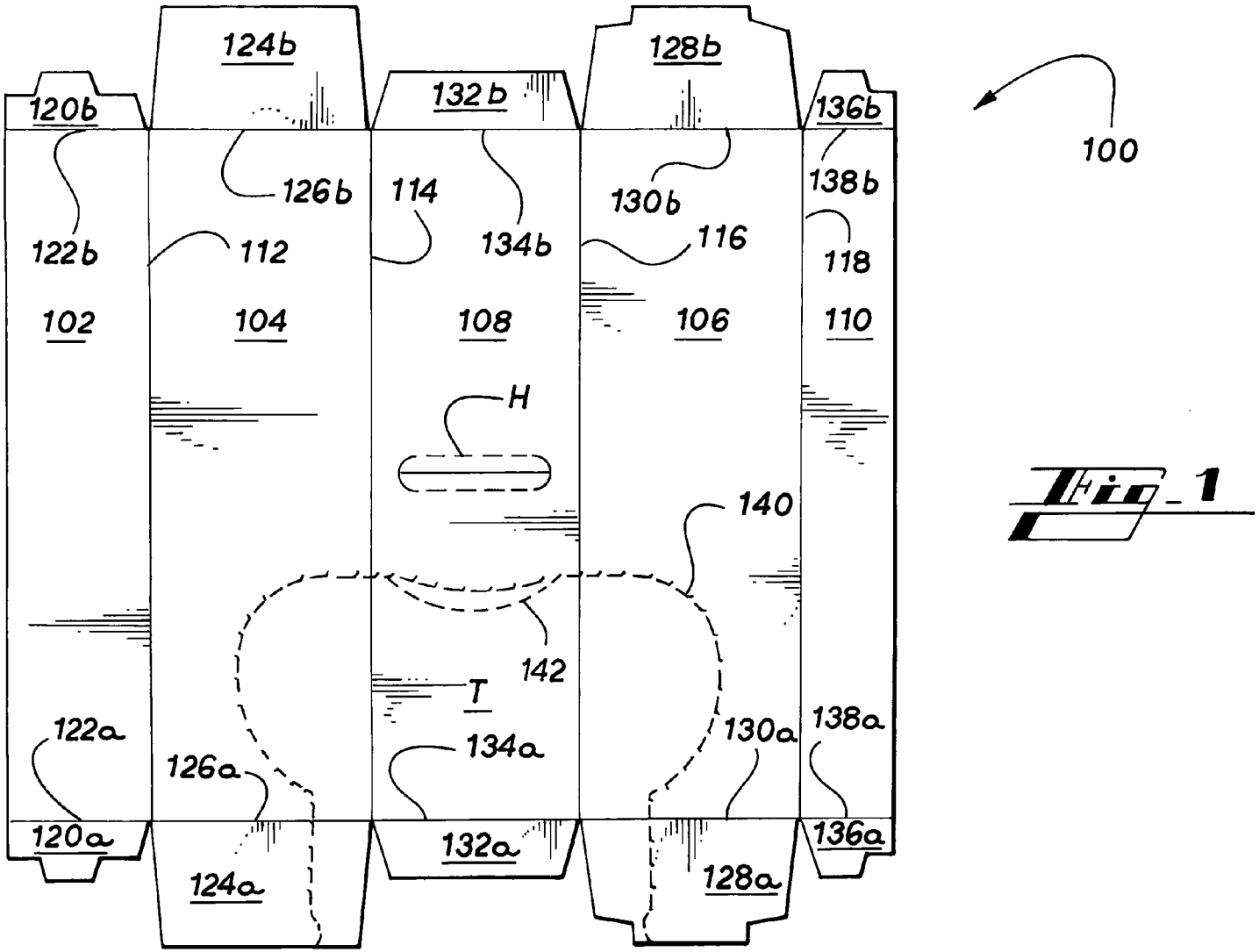
FIG. 1 is a plan view of one embodiment of a blank for forming a carton of the present invention.

As required, detailed embodiments of the present invention are disclosed herein. It will be understood that the disclosed embodiments are merely examples to illustrate aspects of the invention that may be embodied in various and alternative forms. The figures are not necessarily to scale, and some features may be exaggerated or minimized to show details of particular components. In other instances, well-known materials or methods have not been described in detail to avoid obscuring the present invention. Therefore, specific structural and functional details disclosed herein are not to be interpreted as limiting, but as a basis for the claims and for teaching one skilled in the art to variously employ the present invention.

Referring now to the drawings in which like numerals indicate like elements throughout the several views, the drawings show exemplary embodiments of cartons 200 and 400 (shown in FIGS. 2 and 4), which illustrate certain of the various aspects of the present invention. In the embodiments described herein, the cartons are for enclosing, carrying, and dispensing articles such as beverage cans or bottles. Generally described, the cartons are formed from a foldable sheet material such as paperboard, corrugated board, plastic, and the like.

Referring to a first embodiment as shown as FIG. 1, carton 200 is formed from a paperboard blank 100. The blank 100 includes at least four primary panels for forming the carton 200. The panels of the blank 100 include a first bottom panel 102, a first side panel 104, a second side panel 106, a top panel 108, and a second bottom panel 110. The panels 102, 104, 106, 108, and 110 of the blank 100 are hingedly connected to the next. The bottom panel 102 is hingedly connected to the first side panel 104 by fold line 112. The first side panel 104 is hingedly connected to the top panel 108 along fold line 114.

The second side panel 106 is hingedly connected to the top panel 108 along fold line 116. The second bottom panel 110 is hingedly connected to the second side panel 106 along fold line 118. In the illustrated embodiments, a unitary blank is used to form a single carton, although it should be recognized that two or more blanks may be employed, for example, to provide the dispenser structure described in more detail below.

Each of the panels 102, 104, 106, 108, and 110 is hingedly connected to opposing end flaps or end wall panels defined in part by transverse fold lines disposed along opposite edges of the respective panel. When the carton 200 is erected, the end flaps and end wall panels cooperate to form an end wall or end closure structure. In the embodiment illustrated, each end closure structure is sufficiently identical that like references have been used, with "a" or "b" affixed to distinguish one end of the carton from the other. First bottom panel 102 is hingedly connected to end flap 120*a* along fold line 122*a*. First side panel 104 is hingedly connected to end wall panel 124*a* along fold line 126*a*. Second side panel 106 is hingedly connected to end wall panel 128*a* along fold line 130*a*. Top panel 108 is hingedly connected to end flap 132*a* along fold line 134*a*. Second bottom panel 110 is hingedly connected to end flap 136*a* along fold line 138*a*.

Figure 2:
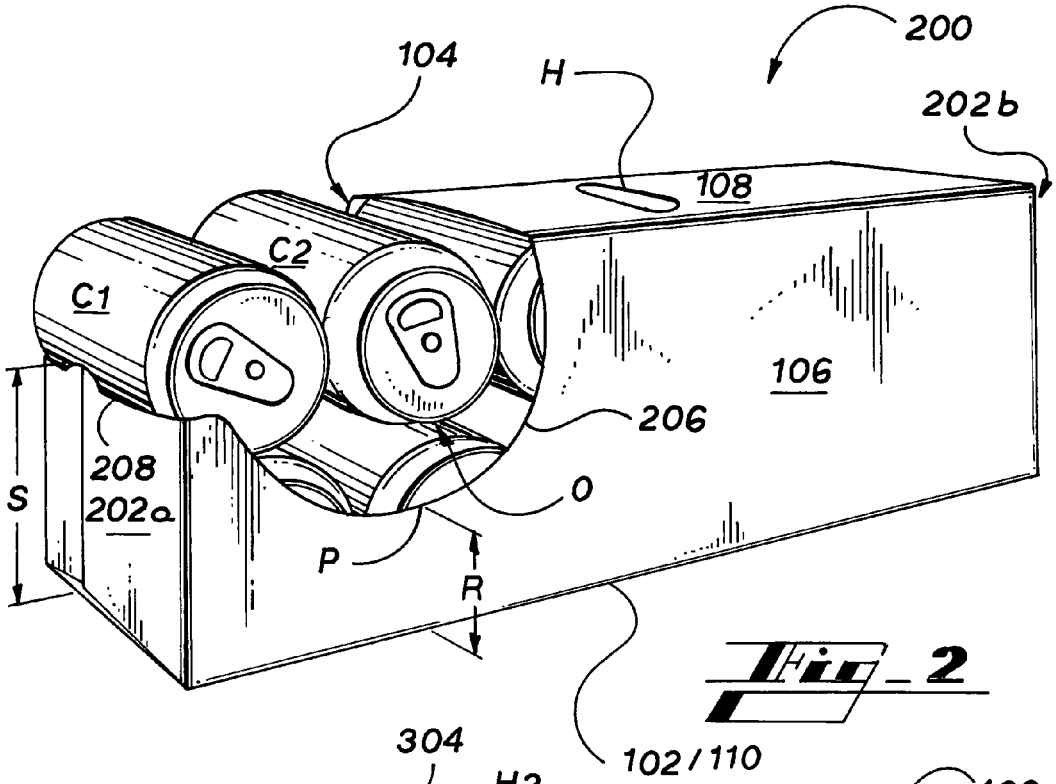
FIG. 2 is a perspective view of a carton of the present invention formed from the blank of FIG. 1, the carton having been opened by removal of a detachable portion.

To erect the illustrated carton 200, first bottom panel 102 is glued or is otherwise secured to second bottom panel 110, to form the composite bottom wall 102/110 of open ended tubular carton 200. Those skilled in the art will recognize that the relative widths of bottom panels 102, 110 may vary, such that for example, second bottom panel 110 may be an edge flap for searing first bottom panel to second side panel 106. After the articles are grouped and loaded through either or both of the open ends of the carton 200, the end flaps and end wall panels are folded and secured together to form opposing end closure structures 202*a* and 202*b* of carton 200. End flap 120*a* is secured to end flap 136*a* whereas end wall panel 124*a* is secured to end wall panel 128*a*. Additionally, end flaps 120*a*, 132*a*, and 136*a* may optionally support the integrity of the carton by being secured to end wall panel 124*a* and to end wall panel 128*a*. The end flaps 120*b*, 132*b* and 136*b*, and end wall panels 124*b* and 128*b*, cooperate similarly to form the opposing end closure structure. As can be seen in FIG. 2, which shows the carton 200 in an opened condition, the end closure structures form respective end walls 202*a* and 202*b*.

The cartons illustrated in the drawings are adapted to hold a group of similarly dimensioned, preferably cylindrical articles such as cans or bottles. Each tier comprises a horizontally arranged row of articles disposed on sides thereof in a side by side parallel fashion. The tiers are vertically disposed one atop the next. The resultant arrangement approximates a matrix wherein the endmost article in each tier is in an endmost column of articles, the second endmost article in each tier is in a second endmost column of articles, and so forth. The articles in each row are disposed on their sides in a side-by-side parallel fashion. For example, the articles may be enclosed in a 2×6 arrangement comprising a first tier—the lowermost row of six articles, and a second tier—an uppermost row of six articles disposed directly above the lowermost row of articles. In a three tiered arrangement, such as a 3×6, an intermediate row of articles is disposed between the uppermost and lowermost rows described in the forgoing example.

As shown in FIG. 2, side walls 104 and 106 are disposed alongside the respective ends of the articles of the group, while each end wall 202*a* and 202*b* of the carton is disposed adjacent to the side walls of the endmost articles in the respective endmost column.

As can be seen in FIG. 1, the blank 100 includes a frangible severance line 140, which when the carton is erected, defines a removable portion T. To define removable portion T, the severance line 140 extends substantially longitudinally from the distal edge of end wall panel 124*a*, crossing fold line 126*a* onto side wall 104 where it forms a U or C shape by curving toward the bottom panel 102 and toward the top panel 108, crossing fold line 114 to transversely traverse top wall 108, crossing fold line 116 onto side wall 106 where it again forms a U or C shape by curving toward the bottom panel 110 and toward the top panel 108, and crossing fold line 130*a* to terminate at the distal edge of end wall panel 128*a*. It is contemplated that the severance line 140 includes, but is not limited to, perforations, a line of perforations, a line of short slits, a line of half cuts, a single half cut, any combination of perforations, slits, score lines, and half cuts, or the equivalent.

Figure 4:
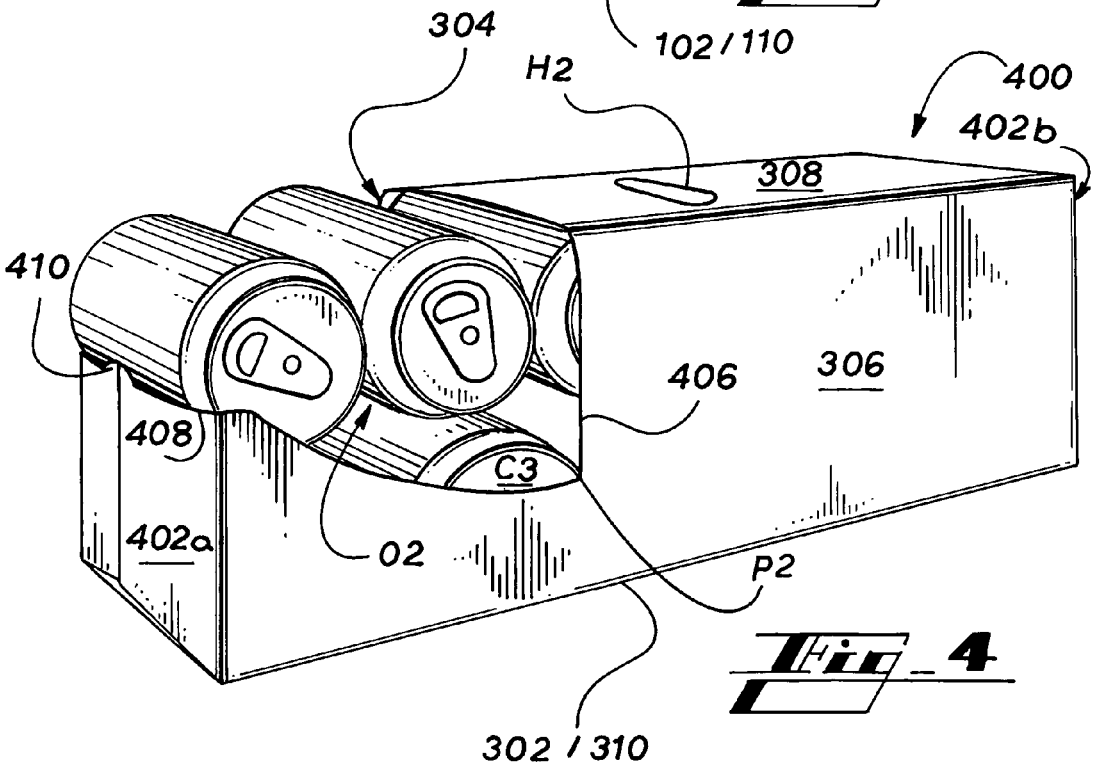
FIG. 4 is a perspective view of a carton of the present invention formed from the blank of FIG. 3, the carton having been opened by removal of a detachable portion.

The blank 100 optionally includes one or more tear or severance initiation means, shown in FIG. 1 as a substantially arcuate fold line 142 having one end at or near the intersection of fold line 114 and severance line 140, and another end at or near the intersection of fold line 116 and severance line 140. To open the carton of FIG. 2, a user grasps the removable portion T by pressing one or more fingers on the area between the arcuate fold line 142 and severance line 140, thereby separating a section of the removable portion T along the top wall segment of severance line 140. The user then grasps and pulls the now separated section of removable portion T at least slightly upward and toward end wall 202*a*, thereby separating the remainder of removable portion T from carton 200 along the remainder of severance line 140. Another tear initiation means is best seen in FIG. 4 as push tab 410, which for example, can enable the user to open the carton starting from the end wall 402*a*. To create push tab 410, the distal ends of severance line 340 in blank 300, best shown in FIG. 3, may curve and cooperate in the erected carton 400.

The positions of arcuate fold line 142 and the top wall segment of severance line 140 are preferably in registry with the space between the second and thrid endmost articles on the top tier of the carton 200, with the severance line 140 preferably aligning perfectly above the abutting sides of the second and third articles on the top tier. This positioning facilitates tear initiation, because the second and third articles on the top tier of the carton support the top wall, encouraging yielding of the top wall only at the fold line 142, and thereby concentrating the pressure on the severance line 140.

The blank 100 may also include a suitable known handle H to allow the user to carry the carton.

As best shown in FIG. 2, the segment of the severance line 140 that traverses side wall 106, hereinafter referred to as a "side wall severance line," defines a recess 206 that preferably arches convexly toward the composite bottom wall 102/110 of the carton 200, such that the recess 206 is substantially U or C shaped upon detachment of removable portion T. A substantially identical recess 204 is defined in side wall 104 on the opposite side of the carton, but is not shown in the figure. The side wall severance line extends to the connection of the respective side wall 106 with end wall 202*a* at a distance above the composite bottom wall 102/110 generally no less than half of the height of the carton 200. The lowest point P of the recess 206 may be spaced at a distance "R" above the composite bottom wall 102/110 less than a half of the height of the carton 200. Preferably, the distance between the lowest point P and the composite bottom wall 102/110 is less than the diameter of a single article, and is positioned so as to expose at least two articles on the lowermost tier, thereby facilitating removal of articles from the lowermost tier in the article group.

The segment of the severance line 140 that extends across the end wall 202*a*, hereinafter referred to as the "end wall severance line," extends continuously between the side walls 104 and 106 so that upon removal of the removable portion T, an article stopper wall is formed from the end wall 202*a*. The height of the stopper wall, as defined as the greatest distance S between the end wall severance line and the composite bottom wall 102/110 of the carton 200, is no less than the distance R between the lowest point P of recess 206 and the composite bottom wall 102/110. Preferably, the distance S is no less than or equal to $$(N \times D) - \tfrac{1}{2} D,$$

where N is the number of vertically arranged tiers of articles in the article group, and D is the diameter of each article. The distance R is preferably less than the diameter D of one of the articles.

Figure 3:
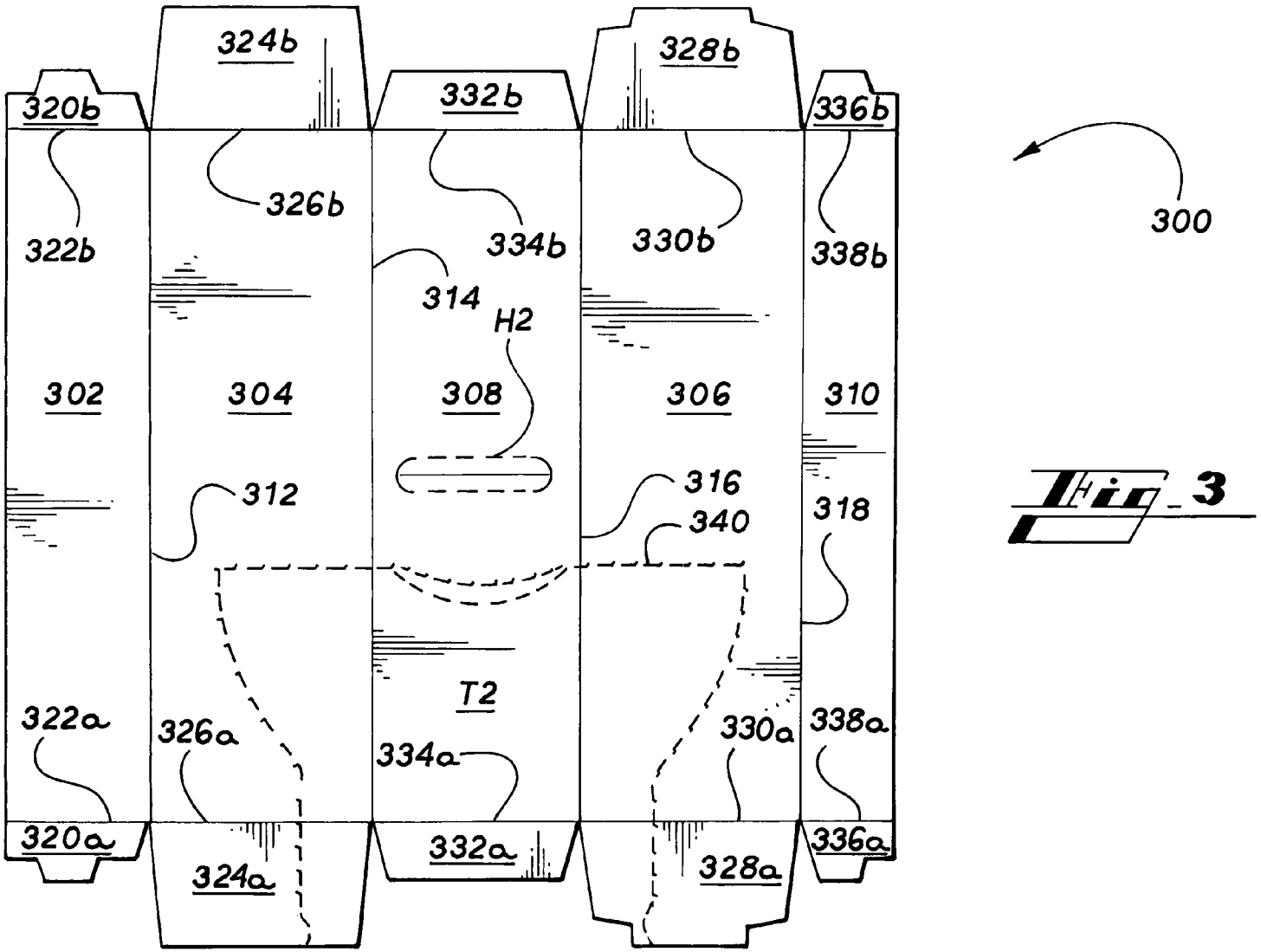
FIG. 3 is a plan view of an alternative embodiment of a blank for forming another carton of the present invention.

FIGS. 3 and 4 illustrate an alternative embodiment of a blank 300 for forming the carton 400, and like references have been used with the prefix "3" in FIG. 3, and with the prefix "4" in FIG. 4. The carton 400 differs from carton 200 primarily in that carton 400 has a removable portion T2 that is shaped differently than removable portion T described above. The blank 300 is similar to blank 100, described above, except that the side wall severance lines define V shaped recesses 404 (not shown) and 406 as opposed to the U or C shaped recess 206 of FIG. 2. Either or both sides of the V shaped recess may be slightly curved.

Referring to FIG. 3, the blank 300 includes a frangible severance line 340, which when the carton is erected, defines a removable portion T2. To define removable portion T2, the severance line 340 extends substantially longitudinally from the distal edge of end wall panel 324*a*, crossing fold line 326*a* onto side panel 304 where it forms a V shape by extending toward the bottom panel 302 to a well-defined point and toward the top panel 308, crossing fold line 314 to transversely traverse top panel 308, crossing fold line 316 onto side panel 306 where it again forms a V shape by extending toward the bottom panel 310 to a well-defined point and toward the top panel 308, finally, crossing fold line 330*a* to terminate at the distal edge of end wall panel 328*a*. It is contemplated that the severance line 340 includes, but is not limited to, a line of perforations, a score line, a line of short slits, a line of half cuts, a single half cut, any combination of slits, score lines, and half cuts, or the equivalent.

The blank 300 may further comprise a suitable known handle H2 to allow the user to carry the carton.

As best shown in FIG. 4, side wall severance line, which traverses side wall 306 defines a recess 406 that preferably arches toward the composite bottom wall 302/310 of the carton 400, such that the recess 406 is substantially V shaped upon detachment of removable portion T2. A substantially identical recess 404 (not shown) is defined in side wall 304 on the opposite side of the carton, but is not shown in the figure. The side wall severance line extends to the connection of the respective side wall 306 with end wall 402*a* at a distance above the composite bottom wall 302/310 generally no less than half of the height of the carton 400. The lowest point P2 of the recess 406 is spaced at a distance above the composite bottom wall 302/310 less than a half of the height of the carton 400. Preferably, the distance between the lowest point P2 and the composite bottom wall 302/310 is less than the diameter of a single article, and is positioned so as to expose at least two articles on the lowermost tier, thereby facilitating removal of articles from the lowermost tier in the article group.

The V shaped recess 406 of carton 400 is advantageous over the prior art at least in part because it facilitates access to the second article in the lowermost tier of the article group by increasing the amount of the revealed end portion of the article. Particularly when the carton 400 is stored on an upper shelf of a refrigerator, a user may find it easier to grasp an article C3 in the second position rather than in the endmost position because a less severe angle of attack may be used, i.e., the user need not bend his or her wrist as much to grasp the desired article C3.

Removal of each of removable portions T and T2 from cartons 200 and 400 defines an opening O or O2 for dispensing articles. For example, as shown in FIG. 2, an endmost article C1 may be removed through the opening O defined by removal of removable portion T as defined by severance line 140. Furthermore, article C2 is also easily accessible through the opening O, which preferably completely exposes at least two articles for simultaneous removal from the carton. The articles C1 and C2 are prevented from accidentally rolling out of the carton 200 through the opening O by the article stopper formed in part by the upper portion of end wall 202*a*. The articles in the lowermost tier are also accessible although restrained by the lower portion of the end wall 202*a* that remains after the removable portion 202*a* has been removed.

As best shown in FIGS. 2 and 4, each carton 200 and 400 includes removable portion T or T2 that extends across top and end walls of the respective cartons and includes recesses 204 (not shown) and 206, or 404 (not shown) and 406 in respective side walls 104 and 106, or 304 and 306 of the respective cartons. However, it should be understood that the orientation of the elements can be varied according to the needs of the consumer particularly with respect to configuration of storage and refrigeration units. As an example, depending on the application, the removable portion of a carton may extend across a side and an end wall, and one or more recesses may be formed in a top wall.

The present invention has been illustrated in relation to a particular embodiment which is intended in all respects to be illustrative rather than restrictive. Those skilled in the art will recognize that the present invention is capable of many modifications and variations without departing from the scope of the invention. For example, as used herein, directional references such as "top", "base", "bottom", "end", "side", "inner", "outer", "upper", "middle", "lower", "front" and "rear" do not limit the respective panels or walls to such orientation, but merely serve to distinguish these panels and walls from one another. Any reference to hinged connection should not be construed as necessarily referring to a single fold line only; indeed, it is envisaged that hinged connection can be formed from one or more of one of the following, a score line, a frangible line or a fold line, without departing from the scope of invention. Those skilled in the art will also appreciate that the shapes and sizes of the end flaps and end wall panels are only examples of the various configurations that will be suitable for implementation of the various embodiments of the invention.

It should be understood that various changes may be made within the scope of the present invention, for example, the size and shape of the panels and apertures may be adjusted to accommodate articles of differing size or shape, alternative end wall structures may be used. The carton may accommodate more than one article in different arrangements. Although the upper edges of the stopper wall 208 and 408 in FIGS. 2 and 4 are shown as being substantially horizontally extending, the upper edges may have any suitable shape, and for example, may be arched, zigzagged, or creatively shaped, provided that the highest point along such an upper edge in a carton enclosing a group of cylindrical articles has dimensions that conform to the relationships and formulas described above. Accordingly, the scope of the present invention is described by the claims appended hereto and supported by the foregoing.

What is claimed is:

1. A package, comprising:

an article group formed of at least two vertically-arranged tiers of cylindrical articles each having a diameter of dimension D, disposed on their sides;

a carton disposed around said article group, said carton comprising a top wall, a pair of opposed side walls, an end wall, and a bottom wall interconnected with one another; and an article-dispenser opening defined by a substantially contiguous line of demarcation extending across said top wall, said end wall and at least one of said opposed side walls, forming a recess in said side wall terminating at a lowermost point disposed adjacent an end of predetermined one of said cylindrical articles in a position in a lowermost tier at least second from an endmost position at a distance from said bottom wall no greater than ½ D so as to reveal a portion of said predetermined one of said cylindrical articles.

2. The package of claim 1, wherein said line of demarcation of said article dispenser opening extends through both of said opposing side walls.

3. The package of claim 1, wherein a highest point of said line of demarcation extending through said end wall is a distance above said bottom wall greater than or equal to [(N×D)−½ D], where N is the number of said vertically-arranged tiers.

4. The package of claim 1, wherein said article-dispenser opening provides access to at least one article in an uppermost tier.

5. The package of claim 4, wherein said article-dispenser opening provides access to at least two endmost articles in an uppermost tier.

* * * * *